US005406262A

United States Patent [19]

Herman et al.

[11] Patent Number: 5,406,262

[45] Date of Patent: Apr. 11, 1995

[54] ADJUSTING MAGNETIC BIAS FIELD INTENSITY IN EAS PRESENCE DETECTION SYSTEM TO ENHANCE DETECTION

[75] Inventors: Fred W. Herman, Tampa; Lincoln H. Charlot, Jr., St. Petersburg; Ming R. Lian, Clearwater; Douglas A. Drew, Tampa, all of Fla.

[73] Assignee: Security Tag Systems, Inc., Deerfield Beach, Fla.

[21] Appl. No.: 78,559

[22] Filed: Jun. 16, 1993

[51] Int. Cl.[6] ..... G08B 13/14

[52] U.S. Cl. ..... 340/572; 340/551

[58] Field of Search ..... 340/572, 551, 568; 342/27, 442

[56] References Cited

U.S. PATENT DOCUMENTS

| | | | |
|---|---|---|---|
| 3,747,086 | 7/1973 | Peterson | 340/280 |
| 4,510,490 | 4/1985 | Anderson, III et al. | 340/572 |
| 4,654,641 | 3/1987 | Ferguson et al. | 340/551 |
| 4,727,360 | 2/1988 | Ferguson et al. | 340/572 |
| 4,779,076 | 10/1988 | Weaver | 340/572 |
| 4,791,412 | 12/1988 | Brooks | 340/572 |
| 5,049,857 | 9/1991 | Plonsky et al. | 340/572 |

*Primary Examiner*—John K. Peng
*Assistant Examiner*—Benjamin C. Lee
*Attorney, Agent, or Firm*—Edward W. Callan

[57] ABSTRACT

An EAS presence detection system includes a transmitter for transmitting an electromagnetic radiation signal of a first predetermined frequency into a surveillance zone; a tag for attachment to an article to be detected within the surveillance zone, the tag containing a transponder including a material that, when in the presence of a magnetic bias field within a predetermined magnetic field intensity range, responds to detection of electromagnetic radiation of the said first predetermined frequency by transmitting electromagnetic radiation of a second predetermined frequency that is either a multiple harmonic or a frequency-divided quotient of the first predetermined frequency or at the first frequency; a detection system disposed for detecting radiation of the second predetermined frequency within the surveillance zone; and a magnetic field source for providing a magnetic bias field within the predetermined magnetic field intensity range within the surveillance zone. The magnetic field source includes a coil disposed in or adjacent the surveillance zone and an adjustable current source for causing a current to flow through the coil to provide a magnetic bias field within the surveillance zone. The coil is a large aperture solenoid coil wound on a core of metallic material of high permeability and high magnetic saturation. The core may be shielded from the electromagnetic radiation field of the first predetermined frequency by a non-ferrous electrically conductive tube disposed around the coil. The amplitude of the current is adjusted to provide a magnetic bias field within said predetermined magnetic field intensity range within the surveillance zone. The amplitude of the current is varied to sweep the intensity of the magnetic bias field through such a range of magnetic field intensities as to cause the magnetic bias field within each portion of the surveillance zone to be within said predetermined magnetic field intensity range during at least a portion of said sweep. A control system is coupled to the detection system and the adjusting means to determine whether detection by the detection means of electromagnetic radiation at the second predetermined frequency is due to the movement of a tag through the surveillance system or is due to the presence of a stationary tag in or near the surveillance zone.

16 Claims, 2 Drawing Sheets

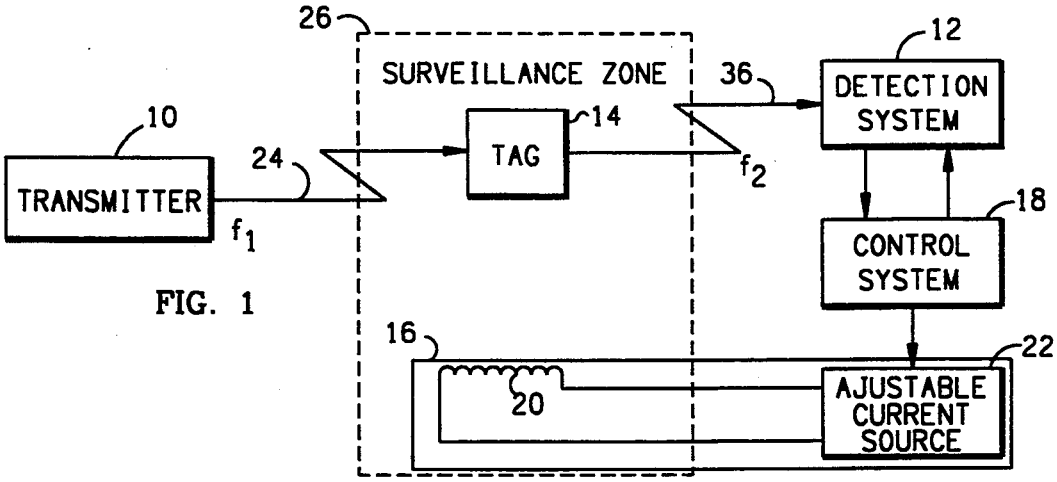
FIG. 1
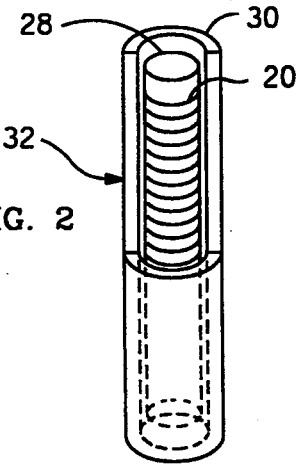
FIG. 2
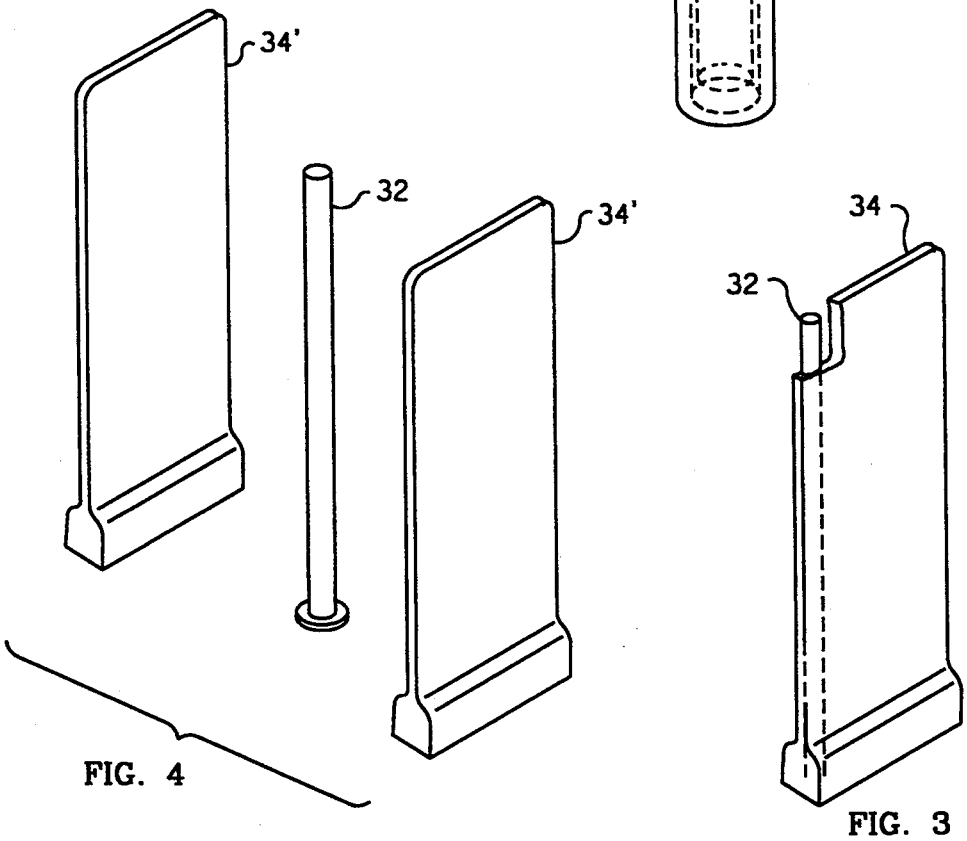
FIG. 4
FIG. 3

ADJUSTING MAGNETIC BIAS FIELD INTENSITY IN EAS PRESENCE DETECTION SYSTEM TO ENHANCE DETECTION

BACKGROUND OF THE INVENTION

The present invention generally pertains to electronic article surveillance (EAS) systems and is particularly directed to an improvement in a presence detection system used for detecting the presence of an article within a surveillance zone.

An EAS presence detection system includes means for transmitting electromagnetic radiation of a first predetermined frequency into a surveillance zone; a tag for attachment to an article to be detected within the surveillance zone, with the tag containing a transponder that responds to detection of electromagnetic radiation of the said first predetermined frequency by transmitting electromagnetic radiation of a second predetermined frequency; and means for detecting radiation of the second predetermined frequency within the surveillance zone. The transponder includes one of a number of different types of materials that, when within a predetermined magnetic field intensity range, responds to detection of electromagnetic radiation of the said first predetermined frequency by transmitting electromagnetic radiation of a second predetermined frequency that is either a multiple harmonic or a frequency-divided quotient of the first predetermined frequency or at the first frequency. In the prior art, a magnetic bias field within said predetermined magnetic field intensity range is provided within the surveillance zone either by including within the transponder a bias strip of magnetic material that provides a magnetic bias field within said predetermined magnetic field intensity range or by disposing a permanent magnet within or adjacent the surveillance zone. Although the latter technique enables smaller and less expensive tags to be used, since the transponder need not include a bias strip, the latter technique may be less reliable because, due to normal processing variations during preparation of the transponder material that responds, not all transponders respond within the same predetermined magnetic field intensity range, and also because a magnetic bias field provided from a discrete source decreases in intensity with distance from the source. Also, ambient magnetic fields, which combine with the magnetic field provided by the magnetic field source to provide the resultant o magnetic bias field within the surveillance zone, vary from location to location and sometimes even within the surveillance zone due to variations in the Earth's magnetic field and the presence of different ferromagnetic structures near the surveillance zone at different locations. Even when the former technique is used, a non-uniform ambient magnetic field throughout the surveillance zone may prevent a transponder including a bias strip from responding when within a portion of a surveillance zone if the ambient magnetic field in such portion of the surveillance zone is of such intensity that the total magnetic field intensity in such portion resulting from a combination of the ambient magnetic field intensity and the magnetic field intensity provided by the bias strip included in the transponder is outside of the predetermined magnetic field intensity range.

SUMMARY OF THE INVENTION

The present invention provides a presence detection system, comprising means for transmitting an electromagnetic radiation signal of a first predetermined frequency into a surveillance zone: a tag for attachment to an article to be detected within the surveillance zone, the tag containing a transponder including a material that, when in the presence of a magnetic bias field within a predetermined magnetic field intensity range, responds to detection of electromagnetic radiation of the said first predetermined frequency by transmitting electromagnetic radiation of a second predetermined frequency that is related to the first frequency; detection means disposed for detecting radiation of the second predetermined frequency within the surveillance zone; and means for providing said magnetic bias field within said predetermined magnetic field intensity range within the surveillance zone; wherein the means for providing said magnetic bias field include means for adjusting the intensity of said magnetic bias field within the surveillance zone to be within said predetermined magnetic field intensity range; and the adjusting means are adapted for sweeping the intensity of the magnetic bias field through such a range of magnetic field intensities as to cause the magnetic bias field within each portion of the surveillance zone to be within the predetermined magnetic field intensity range during at least a portion of said sweep. The statement that the second predetermined frequency is related to the first predetermined frequency means that the second predetermined frequency is either a multiple harmonic or a frequency-divided quotient of the first predetermined frequency or at the first predetermined frequency. The means for adjusting the intensity of the magnetic bias field enable the magnetic bias field within the surveillance zone to be adjusted in accordance with the ambient magnetic field conditions within the surveillance zone at the location where the presence detection system is installed.

Causing the magnetic bias field within each portion of the surveillance zone to be within the predetermined magnetic field intensity range during at least a portion of said sweep thus prevents would-be thieves from escaping detection by carrying tag-attached merchandise through regions within a surveillance zone where the transponder does not respond due to the magnetic bias field not being within the predetermined range.

Sweeping the intensity of the magnetic bias field through a range of magnetic field intensities also enhances the detection of a variety of tags that respond within different predetermined magnetic field intensity ranges, and thereby eases inspection acceptance tolerances for tags that respond within different ranges due to normal processing variations during preparation of the transponder material.

Sweeping the intensity of the magnetic bias field through a range of magnetic field intensities also enables a control system coupled to the detection system and the adjusting means to determine whether detection by the detection means of electromagnetic radiation at the second predetermined frequency is due to the movement of a tag through the surveillance system or is due to the presence of a stationary tag in or near the surveillance zone. The latter condition sometimes occurs when tag bearing merchandise is displayed near a surveillance zone.

In a preferred embodiment, the means for providing the magnetic bias field include a coil disposed in or adjacent the surveillance zone; means for causing a current to flow through the coil to provide said magnetic bias field within the surveillance zone; and means for adjusting the amplitude of said current to provide said magnetic bias field within said predetermined magnetic field intensity range within the surveillance zone; and the adjusting means are adapted for varying the amplitude of said current to sweep the intensity of said magnetic bias field through such a range of magnetic field intensities as to cause the magnetic bias field within each portion of the surveillance zone to be within said predetermined magnetic field intensity range during at least a portion of said sweep. The surveillance zone is a three-dimensional space in which it is desired to detect the presence of an article from which the transponder has not been removed or in which the transponder has not been deactivated.

In another aspect of the present invention, the means for providing said magnetic bias field include a large aperture solenoid coil wound on a core of metallic material of high permeability and high magnetic saturation and disposed in or adjacent the surveillance zone; and means for causing a current to flow through the coil to provide said magnetic bias field within said predetermined magnetic field intensity range within the surveillance zone. A large aperture linear solenoid coil enhances the uniformity of the magnetic bias field throughout the surveillance zone.

In a further aspect the present invention provides a presence detection system, comprising means for transmitting an electromagnetic radiation signal of a first predetermined frequency into a surveillance zone; a tag for attachment to an article to be detected within the surveillance zone, the tag containing a transponder including a material that, when in the presence of a magnetic bias field within a predetermined magnetic field intensity range, responds to detection of electromagnetic radiation of the said first predetermined frequency by transmitting electromagnetic radiation of a second predetermined frequency that is related to the first frequency; detection means disposed for detecting radiation of the second predetermined frequency within the surveillance zone; and means for providing said magnetic bias field within said predetermined magnetic field intensity range within the surveillance zone; wherein the means for providing said magnetic bias field include a coil disposed in or adjacent the surveillance zone; means for causing a current to flow through the coil to provide said magnetic bias field within the surveillance zone; and means for adjusting the amplitude of said current to provide said magnetic bias field within said predetermined magnetic field intensity range within the surveillance zone; and wherein said provided magnetic bias field is not uniform throughout the surveillance zone, the system further comprising control means coupled to the detection means and to the adjusting means for responding to detection by the detection means of radiation of the second predetermined frequency by causing the adjusting means to adjust the amplitude of said current until said detection ceases and to maintain said current at said adjusted amplitude for a predetermined interval to enable the detecting means to again detect electromagnetic radiation of the second predetermined frequency if the transponder moves from a position within the surveillance zone occupied by the transponder when said radiation of the second predetermined frequency was first detected to a position within the surveillance zone at which the magnetic field intensity during said predetermined interval is within said predetermined magnetic field intensity range.

Additional features of the present invention are described in relation to the detailed description of the preferred embodiments.

BRIEF DESCRIPTION OF THE DRAWING

FIG. 1 is a diagram of a preferred embodiment of the presence detection system of the present invention.

FIG. 2 is a partially-cut-away perspective view of a large-aperture linear solenoid coil included in a preferred embodiment of the presence detection system of FIG. 1.

FIG. 3 is a partially-cut-away perspective view of a detection-system panel included in the presence detection system of FIG. 1, with the coil of FIG. 2 being installed within said panel in one preferred embodiment of said presence detection system.

FIG. 4 illustrates the placement of a large aperture solenoid coil and two detection-system panels in another preferred embodiment of the presence detection system of FIG. 1.

DETAILED DESCRIPTION

Figure 5:
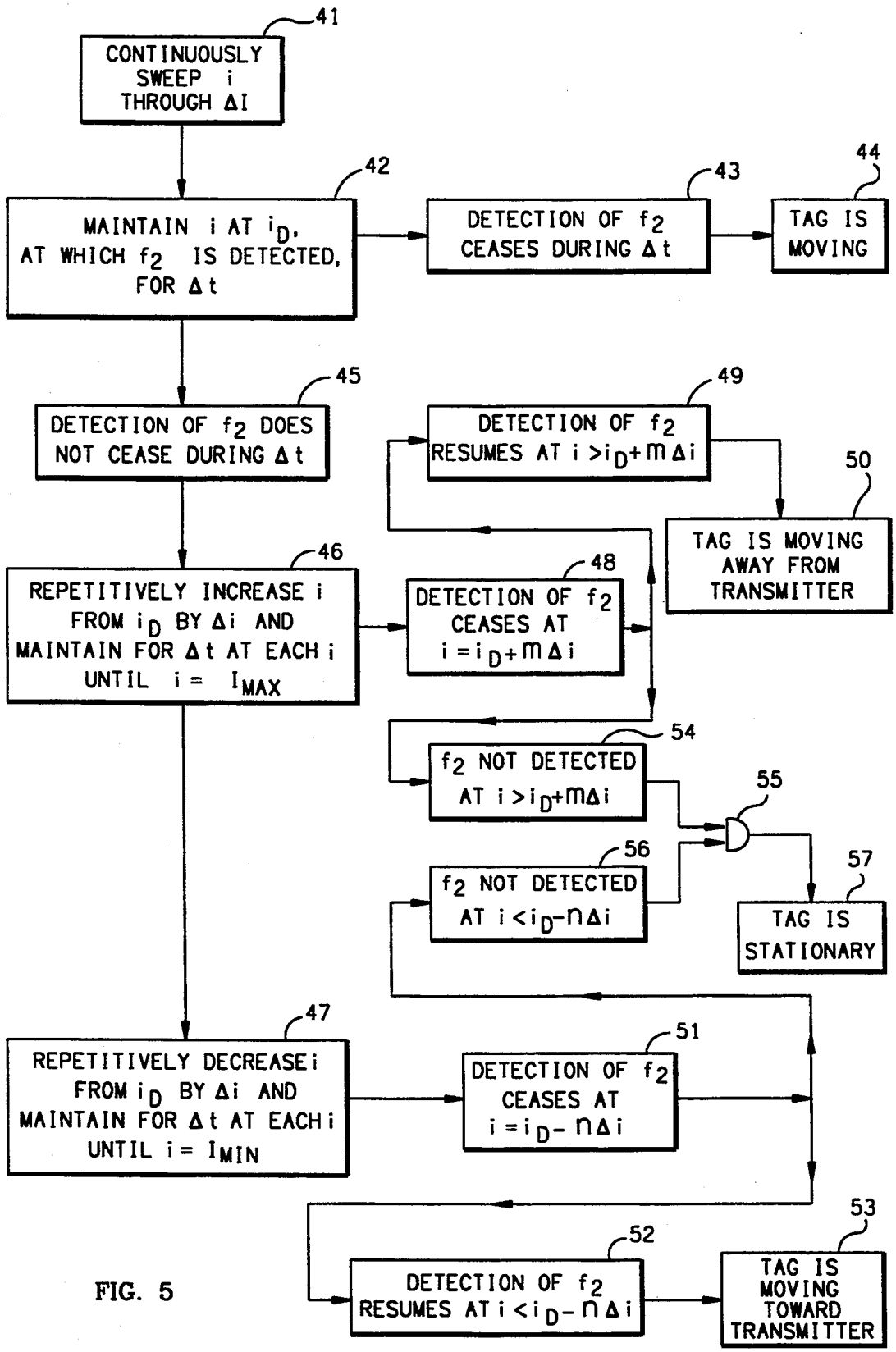
FIG. 5 is a diagram of presence-detection-system operations controlled by the control system included in the system of FIG. 1.

Referring to FIG. 1, a preferred embodiment of a presence detection system according to the present invention includes a transmitter 10, a detection system 12, a tag 14, a magnetic field source 16 and a control system 18. The magnetic field source 16 includes a coil 20 and an adjustable current source 22.

The transmitter 10 includes a signal generator and a coil for transmitting electromagnetic radiation 24 of a first predetermined frequency $f_1$ in the kilohertz band into a surveillance zone 26.

The tag 14 is adapted for attachment to an article to be detected within the surveillance zone 26. The tag 14 contains a transponder including a material that, when in the presence of a magnetic bias field within a predetermined magnetic field intensity range, responds to detection of electromagnetic radiation of a first predetermined frequency $f_1$ by transmitting electromagnetic radiation of a second predetermined frequency $f_2$ that is either a multiple harmonic or a frequency-divided quotient of the first predetermined frequency $f_1$ or at the first predetermined frequency $f_1$. A transponder including a material that responds to detection of electromagnetic radiation of a first predetermined frequency $f_1$ by transmitting electromagnetic radiation of a second predetermined frequency $f_2$ that is a multiple harmonic of the first predetermined frequency $f_1$ is described in U.S. Pat. No. 3,747,086 to Glen Peterson. A transponder including a material that responds to detection of electromagnetic radiation of a first predetermined frequency $f_1$ by transmitting electromagnetic radiation of a second predetermined frequency $f_2$ that is a frequency-divided quotient of the first predetermined frequency $f_1$ is described in U.S. Pat. No. 4,727,360 to Lucian G. Ferguson and Lincoln H. Charlot, Jr. A transponder including a material that responds to detection of electromagnetic radiation of a first predetermined frequency by effecting a magnetomechanical resonance energy exchange at the first frequency to transmit electromagnetic radiation of the first predetermined frequency $f_1$ is described in U.S. Pat. No. 4,510,490 to Philip M. Anderson, III, et al.

The coil 20 is a large-aperture linear solenoid coil, as shown in FIG. 2. In a preferred embodiment of the presence detection system adapted for detecting the presence of tags 14 attached to articles of merchandise being removed from a retail sales area, the length of the coil 20 is in a range of from three to six feet, and preferably is approximately four feet. The cross-sectional area of the coil 20 is in a range of approximately one to three inches. The coil 20 is of copper wire and is wound on a core 28 of metallic material of high permeability and high magnetic saturation, with the coil turns being contiguous to minimize radial magnetic flux leakage and concentrate most of the flux at the ends of the solenoid coil 20. The size of the wire and the number of turns in the coil 20 are chosen to maximize the intensity of the magnetic bias field, with minimum resistance heat loss.

A tube 30 of non-ferrous electrically conductive metal, such as copper or aluminum, may be disposed around the coil 20 for shielding the coil 20 and the core 28 from the transmitted electromagnetic radiation signal 24 of the first predetermined frequency. Such shielding is preferred when the strength of the electromagnetic radiation of the first predetermined frequency at the location of the coil 20 is such as to cause the core 28 to exhibit a significant magnetization loss due to high hysteresis and eddy current losses at such frequency. There is negligible heating of the tube 30 or of the shielded coil 20 and core 28 and thus very little absorption by the coil assembly 32 of the energy of the transmitted electromagnetic radiation signal 24 of the first predetermined frequency.

The coil assembly 32, which includes the coil 20, the core 28 and the tube 30, is disposed vertically within and at the edge of a panel 34 (FIG. 3 ) of the type that typically is disposed in or adjacent the surveillance zone 26. The panel 34 also includes the coil of the transmitter 10 and a coil of the detection system 12.

In an alternative embodiment of the protection system that includes two such panels 34' in order to enlarge the size of the surveillance zone 26, the coil assembly 32 is disposed in the surveillance zone 26 between the two panels 34', as shown in FIG. 4, rather than within either of the panels 34'. By placing the coil assembly 32 between the two panels 34', the intensity of the magnetic bias field provided by the coil 20 is strongest midway between the panels 34' where the intensity of the electromagnetic radiation of the first predetermined frequency $f_1$ transmitted from the panels 34' by the coils of the transmitter 10 is the weakest; and the intensity of the transmitted electromagnetic radiation of the first predetermined frequency $f_1$ is strongest near the panels 34' where the intensity of the magnetic bias field provided by the coil 20 is the weakest.

The coil 20 may disposed in any other orientation in or adjacent to the surveillance zone 26 that will result in the desired magnetic bias field being produced within the surveillance zone 26.

When a DC current or a low frequency AC current flows through the coil 20, a magnetic bias field is produced within the surveillance zone 26. The current through the coil 20 is provided by the adjustable current source 22, which is adjusted to provide a current through the coil 20 that results in a magnetic bias field within the predetermined magnetic field intensity range being provided within the surveillance zone 26.

The adjustable current source 22 is adapted for varying the amplitude of the current through the coil 20 in such a manner as to sweep the intensity of the magnetic bias field provided by the coil 20 through such a range of magnetic field intensities as to cause the magnetic bias field within each portion of the surveillance zone 26 to be within said predetermined magnetic field intensity range during at least a portion of said sweep. The adjustable current source 22 is adapted for periodically varying the amplitude of said current at a frequency that is higher than the expected rate of movement of a tag-attached article through the surveillance zone 26, but less than one-tenth of one percent of the first predetermined frequency $f_1$.

When the tag 14 is within the surveillance zone 26, the transponder in the tag 14 detects electromagnetic radiation of the first predetermined frequency $f_1$ and responds to said detection by transmitting electromagnetic radiation 36 of a second predetermined frequency $f_2$ that is either a multiple harmonic or a frequency-divided quotient of the first predetermined frequency $f_1$ or at the first frequency $f_1$, depending upon the type of material used in the transponder.

The detection system 12 includes a detection circuit including the detection coil for detecting electromagnetic radiation of the second predetermined frequency $f_2$ within the surveillance zone 26, and thereby detects the presence of the tag 14 within the surveillance zone 26 when the transponder of the tag 14 transmits the electromagnetic radiation 36 of the second predetermined frequency $f_2$. Upon detecting the presence of the tag 14 within the surveillance zone 26, the detection system may respond by providing an audible alarm and/or a visible alarm, such as a flashing visual display light.

The control system 18 is coupled to the detection system 12 and the adjustable current source 22 and takes advantage of a situation in which the magnetic bias field is not uniform throughout the surveillance zone 26 to determine whether detection by the detection system 12 of electromagnetic radiation at the second predetermined frequency $f_2$ is due to the movement of a tag 14 through the surveillance system 26 or is due to the presence of a stationary tag in or near the surveillance zone 26.

The control system 18, which is embodied in a programmed microcomputer, is adapted to respond to detection by the detection system 12 of radiation of the second predetermined frequency $f_2$ by causing the adjustable current source 22 to maintain the current through the coil 20 for a predetermined interval $\Delta t$ at the current $i_D$ at which radiation of the second predetermined frequency $f_2$ was detected to enable said detection to cease during said predetermined interval $\Delta t$ if the transponder 14 moves from a position within the surveillance zone 26 occupied by the transponder 14 when said radiation of the second predetermined frequency $f_2$ was detected to a position within the surveillance zone 26 at which the magnetic field intensity during said predetermined interval $\Delta t$ is not within the predetermined magnetic field intensity range.

The control system 18 is further adapted to respond to detection by the detection system 12 of radiation of the second predetermined frequency 12 by causing the adjustable current source 22 to adjust the amplitude of the current through the coil 20 until said detection ceases and to maintain said current at said adjusted amplitude for said predetermined interval $\Delta t$ to enable the detection system 12 to again detect electromagnetic radiation of the second predetermined frequency $f_2$ if the transponder 14 moves from a position within the surveillance zone 26 occupied by the transponder 14 when said radiation of the second predetermined frequency $f_2$ was detected to a position within the surveillance zone 26 at which the magnetic field intensity during said predetermined interval $\Delta t$ is within said predetermined magnetic field intensity range. The control system 18 is adapted for incrementally adjusting the amplitude of the current through the coil 20 following each said detection of electromagnetic radiation of the second predetermined frequency $f_2$ by the detection system 12 and for maintaining said current at each incrementally adjusted amplitude for said predetermined interval $\Delta t$.

A preferred embodiment of system operations controlled by the control system 18 is described with reference to FIG. 5.

The control system 18 causes the adjustable current source 22 to continuously sweep the coil current i through a predetermined current range $\Delta I$ (as indicated by block 41). When electromagnetic radiation of the second predetermined frequency $f_2$ is detected by the detection system 12, the control system 18 causes the adjustable current source 22 to maintain the coil current i at the current $i_D$ at which the electromagnetic radiation of the second predetermined frequency $f_2$ is detected for the predetermined interval $\Delta t$ (42).

If said detection of the electromagnetic radiation of the second predetermined frequency $f_2$ ceases during the predetermined interval $\Delta t$ (43), the control system 18 determines that the tag 14 from which the detected electromagnetic radiation of the second predetermined frequency $f_2$ was transmitted is moving (44).

If said detection of the electromagnetic radiation of the second predetermined frequency $f_2$ does not cease during the predetermined interval $\Delta t$ (45), the control system 18 causes the adjustable current source 22 to repetitively increase the coil current i by a predetermined incremental quantity $\Delta i$ and to maintain the coil current at each incrementally adjusted amplitude level for the predetermined interval $\Delta t$ until the coil current i equals the maximum current $I_{MAX}$ at the high end of the predetermined current range $\Delta I$ (46); and then causes the adjustable current source 22 to repetitively decrease the coil current i by the predetermined incremental quantity $\Delta i$ and to maintain the coil current at each incrementally adjusted amplitude level for the predetermined interval $\Delta t$ until the coil current i equals the minimum current $I_{MIN}$ at the low end of the predetermined current range $\Delta I$ (47).

If while the current i is being incrementally increased (46), detection of electromagnetic radiation of the second predetermined frequency $f_2$ ceases at some increased current amplitude, $i=i_D+m\Delta i$ (48), but then resumes at a higher current amplitude, $i>i_D+m\Delta i$ (49), the control system 18 determines that the tag 14 is moving away from the transmitter 10 in the embodiment of FIG. 3 (as indicted by block 50).

If while the current i is being incrementally decreased (47), detection of electromagnetic radiation of the second predetermined frequency $f_2$ ceases at some decreased current amplitude, $i=i_D-n\Delta i$ (51), but then resumes at a lower current amplitude, $i<i_D-n\Delta i$ (52), the control system 18 determines that the tag 14 is moving toward from the transmitter 10 in the embodiment of FIG. 3 (as indicted by block 53).

If while the current i is being incrementally increased (46), detection of electromagnetic radiation of the second predetermined frequency $f_2$ ceases at some increased current amplitude, $i=i_D+m\Delta i$ (48), and is not detected at a higher current amplitude, $i>i_D+m\Delta i$ (54), and (as indicated by AND gate 55), if while the current i is being incrementally decreased (47), detection of electromagnetic radiation of the second predetermined frequency $f_2$ ceases at some decreased current amplitude, $i=i_D-n\Delta i$ (51), and is not detected at a lower current amplitude, $i<i_D-n\Delta i$ (56), the control system 18 determines that the tag 14 from which the detected electromagnetic radiation of the second predetermined frequency $f_2$ was transmitted is stationary 57.

The control system 18 inhibits the detection system 12 from providing an alarm when the control system 18 determines that the tag 14 from which the detected electromagnetic radiation of the second predetermined frequency $f_2$ was transmitted is stationary., and thereby prevents provision of an alarm in response to detection of electromagnetic radiation of the second predetermined frequency $f_2$ transmitted from a tag 14 attached to merchandise in a stationary display near the surveillance zone 26.

The control system 18 can also track the movement of a tag 14 throughout the surveillance zone 26 by combining various operations such as those described with reference to FIG. 5. The operation of the control system 18 in tracking the movement of a tag 14 is more complex, however, since both the magnitude and direction of the magnetic field vector vary throughout the surveillance zone 26 and the angular orientation of the transponder tag 14 also varies as the tag 14 is being moved. The tag transponder material that responds is an elongated strip of magnetic material, whereby the angular orientation of the tag 14 affects the response of the transponder as a function of the vector of the magnetic bias field and the intensity of the electromagnetic radiation of the first frequency $f_1$ detected by the transponder. Tracking of tag movement throughout the surveillance zone preferably is implemented by providing the magnetic bias field from a plurality of coils, and by a control system that independently adjusts the currents through the different coils to perform the tracking operation.

We claim:

1. A presence detection system, comprising means for transmitting an electromagnetic radiation signal of a first predetermined frequency into a surveillance zone;

a tar for attachment to an article to be detected within the surveillance zone, the tag containing a transponder including a material that, when in the presence of a magnetic bias field within a predetermined magnetic field intensity range, responds to detection of electromagnetic radiation of the said first predetermined frequency by transmitting electromagnetic radiation of a second predetermined frequency that is related to the first frequency;

detection means disposed for detecting radiation of the second predetermined frequency within the surveillance zone; and means for providing said magnetic bias field within said predetermined magnetic field intensity range within the surveillance zone;

wherein the means for providing said magnetic bias field include adjusting the intensity of said magnetic bias field within the surveillance zone to be within said predetermined magnetic field intensity range; and wherein the adjusting means are adapted for sweeping the intensity of said magnetic bias field through such a range of magnetic field intensities as to cause the magnetic bias field within each portion of the surveillance zone to be within said predetermined magnetic field intensity range during at least a portion of said sweep.

2. A system according to claim 1, wherein the adjusting means are adapted for periodically sweeping said intensity at a frequency that is less than one-tenth of one percent of said first predetermined frequency.

3. A presence detection system, comprising means for transmitting an electromagnetic radiation signal of a first predetermined frequency into a surveillance zone;

a tag for attachment to an article to be detected within the surveillance zone, the tag containing a transponder including a material that, when in the presence of a magnetic bias field within a predetermined magnetic field intensity range, responds to detection of electromagnetic radiation of the said first predetermined frequency by transmitting electromagnetic radiation of a second predetermined frequency that is related to the first frequency:

detection means disposed for detecting radiation of the second predetermined frequency within the surveillance zone; and means for providing said magnetic bias field within said predetermined magnetic field intensity range within the surveillance zone;

wherein the means for providing said magnetic bias field include a coil disposed in or adjacent the surveillance zone;

means for causing a current to flow through the coil to provide said magnetic bias field within the surveillance zone; and means for adjusting the amplitude of said current to provide said magnetic bias field within said predetermined magnetic field intensity range within the surveillance zone; and wherein the adjusting means are adapted for varying the amplitude of said current to sweep the intensity of said magnetic bias field through such a range of magnetic field intensities as to cause the magnetic bias field within each portion of the surveillance zone to be within said predetermined magnetic field intensity range during at least a portion of said sweep.

4. A system according to claim 3, wherein the adjusting means are adapted for periodically varying the amplitude of said current at a frequency that is less than one-tenth of one percent of said first predetermined frequency.

5. A system according to claim 3, wherein said provided magnetic bias field is not uniform throughout the surveillance zone, further comprising control means coupled to the detection means and to the adjusting means for responding to detection by the detection means of radiation of the second predetermined frequency by causing the adjusting means to maintain said current for a predetermined interval at the current at which radiation of the second predetermined frequency was detected to enable said detection to cease during said predetermined interval if the transponder moves from a position within the surveillance zone occupied by the transponder when said radiation of the second predetermined frequency was detected to a position within the surveillance zone at which the magnetic field intensity during said predetermined interval is not within said predetermined magnetic field intensity range.

6. A system according to claim 5, wherein the control means are adapted for incrementally adjusting the amplitude of said current following said detection of electromagnetic radiation of the second predetermined frequency and for maintaining said current at each incrementally adjusted amplitude for said predetermined interval.

7. A system according to claim 5, wherein the control means are further adapted for responding to detection by the detection means of radiation of the second predetermined frequency by causing the adjusting means to adjust the amplitude of said current until said detection ceases and to maintain said current at said adjusted amplitude for said predetermined interval to enable the detecting means to again detect electromagnetic radiation of the second predetermined frequency if the transponder moves from a position within the surveillance zone occupied by the transponder when said radiation of the second predetermined frequency was detected to a position within the surveillance zone at which the magnetic field intensity during said predetermined interval is within said predetermined magnetic field intensity range.

8. A system according to claim 7, wherein the control means are adapted for incrementally adjusting the amplitude of said current following said detection of electromagnetic radiation of the second predetermined frequency and for maintaining said current at each incrementally adjusted amplitude for said predetermined interval.

9. A presence detection system, comprising means for transmitting an electromagnetic radiation signal of a first predetermined frequency into a surveillance zone;

a tag for attachment to an article to be detected within the surveillance zone, the tag containing a transponder including a material that, when in the presence of a magnetic bias field within a predetermined magnetic field intensity range, responds to detection of electromagnetic radiation of the said first predetermined frequency by transmitting electromagnetic radiation of a second predetermined frequency that is related to the first frequency;

detection means disposed for detecting radiation of the second predetermined frequency within the surveillance zone; and means for providing said magnetic bias field within said predetermined magnetic field intensity range within the surveillance zone;

wherein the means for providing said magnetic bias field include a coil disposed in or adjacent the surveillance zone;

means for causing a current to flow through the coil to provide said magnetic bias field within the surveillance zone; and means for adjusting the amplitude of said current to provide said magnetic bias field within said predetermined magnetic field intensity range within the surveillance zone; and wherein said provided magnetic bias field is not uniform throughout the surveillance zone, the system further comprising control means coupled to the detection means and to the adjusting means for responding to detection by the detection means of radiation of the second predetermined frequency by causing the adjusting means to adjust the amplitude of said current until said detection ceases and to maintain said current at said adjusted amplitude for a predetermined interval to enable the detecting means to again detect electromagnetic radiation of the second predetermined frequency if the transponder moves from a position within the surveillance zone occupied by the transponder when said radiation of the second predetermined frequency was first detected to a position within the surveillance zone at which the magnetic field intensity during said predetermined interval is within said predetermined magnetic field intensity range.

10. A system according to claim 9, wherein the control means are adapted for incrementally adjusting the amplitude of said current following said first detection of electromagnetic radiation of the second predetermined frequency and for maintaining said current at each incrementally adjusted amplitude for at least said predetermined interval.

11. A presence detection system, comprising means for transmitting an electromagnetic radiation signal of a first predetermined frequency into a surveillance zone;

a tag for attachment to an article to be detected within the surveillance zone, the tag containing a transponder including a material that, when in the presence of a magnetic bias field within a predetermined magnetic field intensity range, responds to detection of electromagnetic radiation of the said first predetermined frequency by transmitting electromagnetic radiation of a second predetermined frequency that is related to the first frequency;

detection means disposed for detecting radiation of the second predetermined frequency within the surveillance zone; and means for providing said magnetic bias field within said predetermined magnetic field intensity range within the surveillance zone;

wherein the means for providing said magnetic bias field include a coil disposed in or adjacent the surveillance zone;

means for causing a current to flow through the coil to provide said magnetic bias field within the surveillance zone; and means for adjusting the amplitude of said current to provide said magnetic bias field within said predetermined magnetic field intensity range within the surveillance zone; and wherein the coil is a large aperture linear solenoid coil wound on a core of metallic material of high permeability and high magnetic saturation.

12. A system according to claim 11, wherein the means for providing said magnetic bias field further comprises a non-ferrous electrically conductive metal tube disposed around the coil for shielding the coil and the core from the transmitted electromagnetic radiation signal of the first predetermined frequency.

13. A system according to claim 11, wherein the adjusting means are adapted for varying the amplitude of said current to sweep the intensity of said magnetic bias field through such a range of magnetic field intensities as to cause the magnetic bias field within each portion of the surveillance zone to be within said predetermined magnetic field intensity range during at least a portion of said sweep.

14. A system according to claim 13, wherein said provided magnetic bias field is not uniform throughout the surveillance zone, further comprising control means coupled to the detection means and to the adjusting means for responding to detection by the detection means of radiation of the second predetermined frequency by causing the adjusting means to maintain said current for a predetermined interval at the current at which radiation of the second predetermined frequency was detected to enable said detection to cease during said predetermined interval if the transponder moves from a position within the surveillance zone occupied by the transponder when said radiation of the second predetermined frequency was detected to a position within the surveillance zone at which the magnetic field intensity during said predetermined interval is not within said predetermined magnetic field intensity range.

15. A system according to claim 14, wherein the control means are further adapted for responding to detection by the detection means of radiation of the second predetermined frequency by causing the adjusting means to adjust the amplitude of said current until said detection ceases and to maintain said current at said adjusted amplitude for said predetermined interval to enable the detecting means to again detect electromagnetic radiation of the second predetermined frequency if the transponder moves from a position within the surveillance zone occupied by the transponder when said radiation of the second predetermined frequency was detected to a position within the surveillance zone at which the magnetic field intensity during said predetermined interval is within said predetermined magnetic field intensity range.

16. A system according to claim 15, wherein the control means are adapted for incrementally adjusting the amplitude of said current following said detection of electromagnetic radiation of the second predetermined frequency and for maintaining said current at each incrementally adjusted amplitude for said predetermined interval.

* * * * *

UNITED STATES PATENT AND TRADEMARK OFFICE

CERTIFICATE OF CORRECTION

PATENT NO. : 5,406,262

DATED : April 11, 1995

INVENTOR(S) : HERMAN ET AL.

It is certified that error appears in the above-indentified patent and that said Letters Patent is hereby corrected as shown below:

Column 8, line 46, "tar" should read --tag--.

Column 8, line 62, after "include", insert --means for--.

Signed and Sealed this

Seventeenth Day of October, 1995

*Attest:*

*Attesting Officer*

BRUCE LEHMAN

*Commissioner of Patents and Trademarks*